United States Patent [19]

Gidge et al.

[11] 4,296,792

[45] Oct. 27, 1981

[54] TRANSPARENT REACH-THROUGH CURTAIN FOR OPEN REFRIGERATORS

[75] Inventors: Kenneth N. Gidge, Nashua, N.H.; Henry J. Richard, Lowell, Mass.

[73] Assignee: BSL Corporation, Nashua, N.H.

[21] Appl. No.: 9,049

[22] Filed: Feb. 5, 1979

[51] Int. Cl.[3] ..... A47H 1/00

[52] U.S. Cl. ..... 160/332; 160/184; 312/116

[58] Field of Search ..... 160/179, 184, 332, 238, 160/236, 173, 177, 178 R; 312/116, 138, 297; 52/256; 116/209, 278, DIG. 41

[56] References Cited

U.S. PATENT DOCUMENTS

| | | | |
|---|---|---|---|
| 2,111,979 | 3/1938 | Lawson et al. | 160/236 |
| 2,304,534 | 12/1942 | Burns | 160/173 |
| 3,542,445 | 11/1970 | Donker | 312/116 |
| 4,186,790 | 2/1980 | Schenker et al. | 160/179 |

*Primary Examiner*—C. J. Husar

*Assistant Examiner*—C. S. Lieberman

*Attorney, Agent, or Firm*—Morse, Altman, Oates & Dacey

[57] ABSTRACT

A transparent, flexible curtain with spaced access points is provided for installation over the opening of a display type open refrigerator of the sort used in retail food markets. The curtain is comprised of a plurality of elongated, flexible, transparent panels secured at one end to the top or rear edge of the refrigerator cabinet and extending in overlapped relation across the cabinet opening. The edges of the panel are tubular and a colored sleeve may be added to make access points between adjacent panels more readily visible. The curtain retains cold air within the refrigerator and allows the food products to be clearly visible to the customer. Goods are removed by the customer reaching in between adjacent panels which separate easily and return to a closed position when the customer's hand is withdrawn.

6 Claims, 10 Drawing Figures

TRANSPARENT REACH-THROUGH CURTAIN FOR OPEN REFRIGERATORS

BACKGROUND OF THE INVENTION

1. Field of the Invention

This invention relates generally to covers for open front and open top refrigerators and more particularly is directed towards a flexible, reach-through, transparent curtain for use on commercial open refrigerators, such as used in retail food markets.

2. Description of the Prior Art

A great many retail food markets have refrigerators in which various types of foods such as dairy produce and frozen foods are stored until purchased by the customer. Because of the need for constant and easy access to such refrigerators, particularly in a busy market, many of these refrigerators are made with open fronts or open tops which allow the customer to reach directly in and remove whatever item he or she has selected. Refrigerators of this type rely upon the density of cold air to retain cooled air within the unit. While such refrigerators work effectively in keeping the foods chilled, they do require a substantial amount of energy to operate, since the openings usually run the full length of the unit and are often quite large. Refrigerated air within the unit is continuously lost through natural causes such as drafts, convection, movements of the food products by the customers, etc.

While it is possible to install solid doors, either opaque or transparent, on such refrigerators in order to retain cold air, the inconvenience to the customer is objectionable and hinged doors may interfere with traffic flow along narrow store aisles. Also, many customers often leave refrigerator doors ajar so that the function of the door is defeated. It has also been found that transparent doors that are being opened and closed frequently will quickly frost over on the inside so that the refrigerator contents cannot be seen from the outside.

Accordingly, it is an object of the present invention to provide improvements in open type retail refrigerators. Another object of this invention is to provide a novel reach-through curtain for an open type refrigerator. A further object of this invention is to provide a transparent, flexible curtain for an open refrigerator in which refrigerator contents are readily accessible and the curtain remains essentially closed when the goods are withdrawn.

SUMMARY OF THE INVENTION

This invention features a curtain for installation across the open top or front of a commercial retail display type refrigerator, comprising a plurality of flexible, transparent panels connected at one end along the top or rear edge of the refrigerator opening and arranged in overlapping relation. Each panel extends across the opening and is formed with a tube along both long edges in which a colored sleeve insert may be provided to indicate access locations between adjacent panels.

The tubular margins provide rigidity lengthwise of each panel and facilitate access between adjacent panels.

DETAILED DESCRIPTION OF THE PREFERRED EMBODIMENTS

Figure 1:
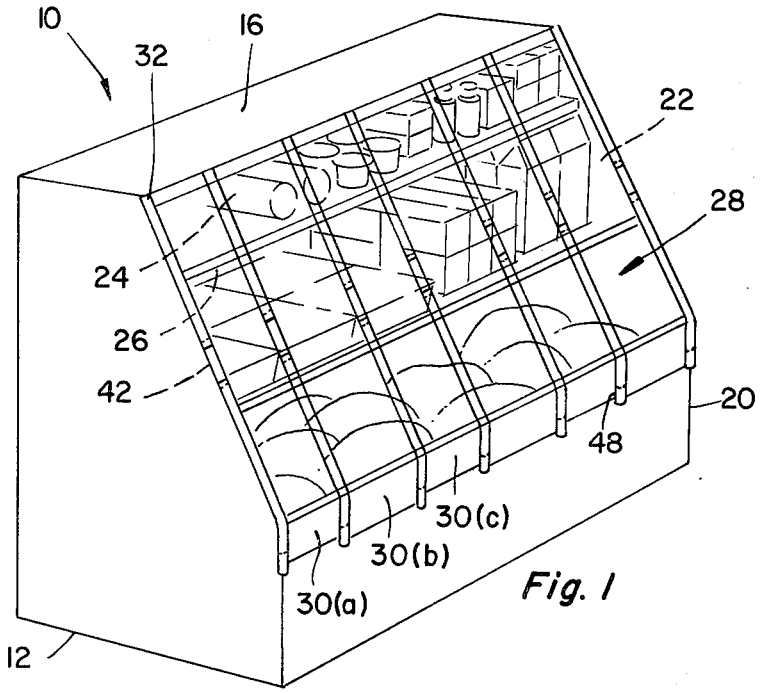
FIG. 1 is a view in perspective of a typical commercial display refrigerator unit equipped with a curtain made according to the invention.
Figure 4:
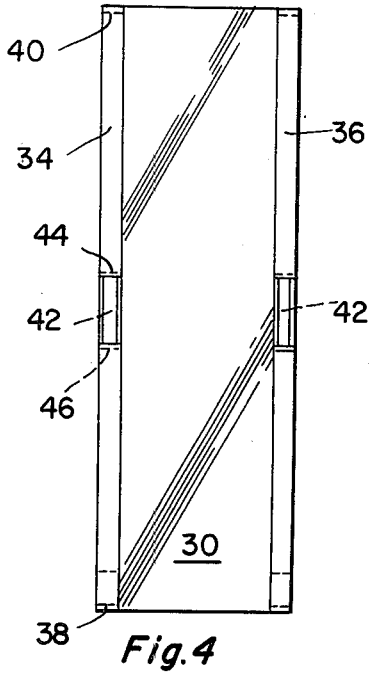
FIG. 4 is a front view of an individual panel made according to the invention.
Figure 5:
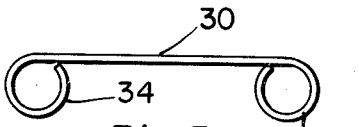
FIG. 5 is an end view thereof.
Figure 2:
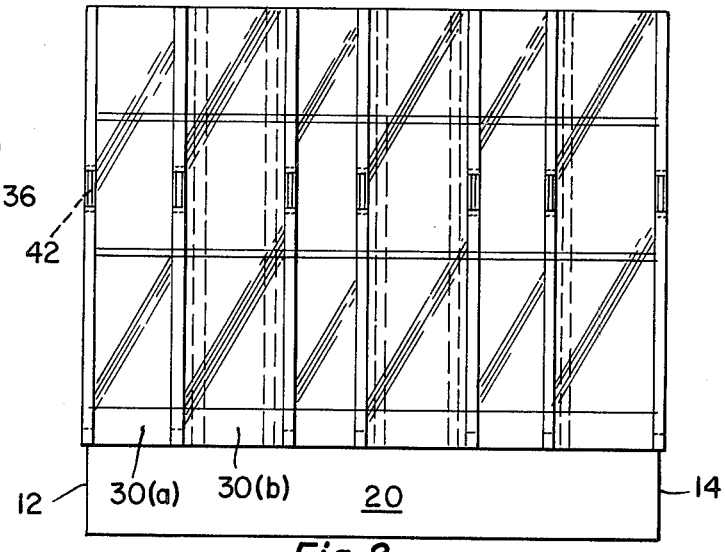
FIG. 2 is a view in front elevation thereof.
Figure 6:
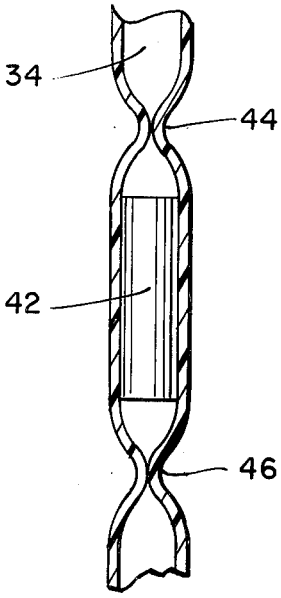
FIG. 6 is a detailed sectional view showing the edge portion of a panel.

Referring now to the drawings and to FIGS. 1 through 7 in particular, the reference character 10 generally indicates a refrigerator unit of the sort commonly employed in retail food markets and adapted to store and display various types of food produce such as dairy produce, frozen foods, meats, etc. that must be kept refrigerated. The unit 10 typically is formed with side walls 12 and 14, a relatively narrow top wall 16, a full height rear wall 18, and a relatively short front wall 20. The walls define a housing with an inclined open front 22 providing access to various food items 24 supported on shelves 26. Typically, the refrigeration mechanism is located within the housing unit 10 and circulates cold air through the storage portion of the unit.

The opening 22 generally is quite large and typically extends the full width of the unit and a substantial portion of the height thereof, so that all shelves and bins are freely accessible to the customers. In practice, the refrigerator opening 22 is left fully open during normal business hours although it may be covered by a tarpaulin, or the like, when the store is closed. With the refrigerator unit 10 open, a substantial amount of energy is required to keep the food produce at the proper temperature because of the large losses of chilled air through the opening 22.

Figure 7:
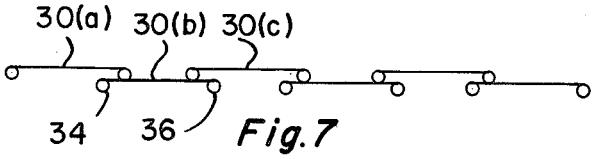
FIG. 7 is a end view showing the overlapped arrangement of the panels.

In accordance with the present invention, a flexible transparent curtain, generally indicated by the reference character 28, is provided across the opening 22. The curtain 28 is comprised of a plurality of individual panels 30(A), 30(B), etc. attached at their upper ends to the upper wall 16 along the edge of the opening 22 and extend down over the opening 22 to drape across the upper edge of the front wall 20. The panels are arranged in overlapping relationship as best shown in FIG. 7 and typically all panels are of the same width and length.

The panels may be made up in a wide variety of widths and lengths with typical dimensions being on the order of perhaps 8" in width and a length perhaps 4' depending upon the size of the opening as well as the number of access points desired through the curtain. These dimensions are only by way of example and can be increased or decreased according to particular requirements. Various plastic sheet material may be used and should be transparent, relatively flexible, stable and durable and not readily subject to cracking from cold or abrasion which may tend to impair the transparency of the panels.

The panels may be attached to the housing by snaps 32 or the like which allow individual panels to be detached for cleaning or replacement, as required. The panels when installed should overlap one another typically by perhaps 1½" to 2" although this may be increased or decreased. Plastic such as vinyl, polyethylene, or the like may be used to fabricate the panels and clear polyethylene vinyl is particularly suitable for this purpose. The material may be provided in various thicknesses from a relatively thin gauge up to perhaps 50 gauge material.

In order to provide a certain amount of longitudinal rigidity to the panels as well as to improve sealing and access between adjacent panels, each panel is formed along its longitudinal edges with tubes 34 and 36. The tubes may be formed by simply rolling the long edges of each panel then securing the ends of each tube formed thereby by means of seams 38 and 40 at the top and bottom ends of each tube. The seam may be made by heat sealing, sewing, staples or the like.

In order to provide a better tubular configuration along the edges of each panel, and to make the access joints between adjacent panels more visible, a relatively rigid short cylindrical sleeve 42 may be inserted midway along the tubes 34 and 36 and secured by seams 44 and 46 above and below the sleeve 42. The seams 44 and 46 again may be heat sealed joints, stitches, staples, or the like. In practice the sleeve 42 is of a relatively bright color so as to stand out clearly against the transparent vinyl panel by means of which a customer may quickly locate the overlap access slit between adjacent panels.

The tubes 34 and 36 not only provide some longitudinal rigidity to each flexible panels so as to prevent the panels from draping excessively into the refrigerator opening 22, but also provide a smooth rounded edge at the points of access through the curtain. A customer wishing to purchase an item of food 24 within the case, simply inserts his hand between the adjacent panels at the point where the panels overlap and near the selected food item. The rounded edges provided by the tubes allows a customer to insert his or her hand smoothly through the curtain and withdraw it with the article 24. The rounded edges prevent any possible cutting, scraping or scratching of the customers hand which might occur with a sharp edge of a single ply of plastic and also prevents cracking and wear on an exposed single edge of a panel. Further, the rolled tubes 34 and 36 provide a better seal between adjacent panels since the panels tend to lay flat against one another without displaying the waviness which often develops in flexible sheet vinyl and similar sheet plastic.

The ends of the panels should overhang the upper edge of the front wall 20 by several inches in order to allow the panels to move in and out to some extent as a result of customers reaching through the curtain and displacing the panels. In order to improve the hang of the panels, the lower ends of each panel may be provided with weights 48 or springs might be added to secure in a yielding fashion the lower ends of the panels to the cabinet. The weights or the springs would provide increased tension to the panels to insure that the panels remain in proper position across the opening despite frequent displacement by customers.

Figure 8:
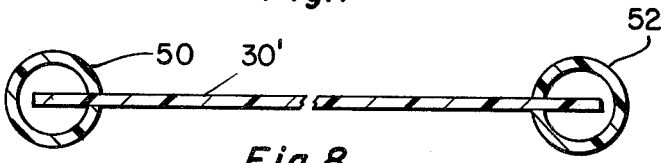
FIG. 8 is a sectional end view showing a modification of the invention.
Figure 3:
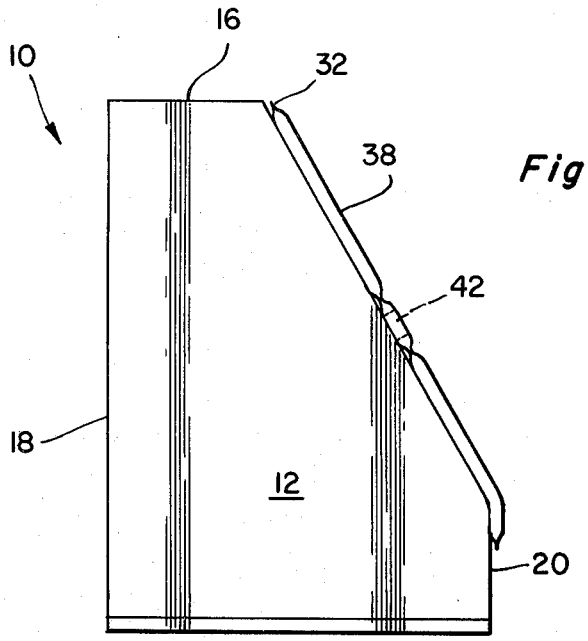
FIG. 3 is a view in side elevation thereof.

Referring now to FIG. 8 of the drawings, there is illustrated a modification of the invention and, in this embodiment, a panel 30' is provided with longitudinally slit tubes 50 and 52 along the long edges thereof in place of the rolled tubes 34 and 36 of the principal embodiment. The tubes 50 and 52 may be of a somewhat stiff plastic material such as PVC, or the like, and are installed by forming a longitudinal slit therein and slipping them over the long edges of the panel. The tubes may then be secured in place by cementing the slit edges to the panel.

Figure 9:
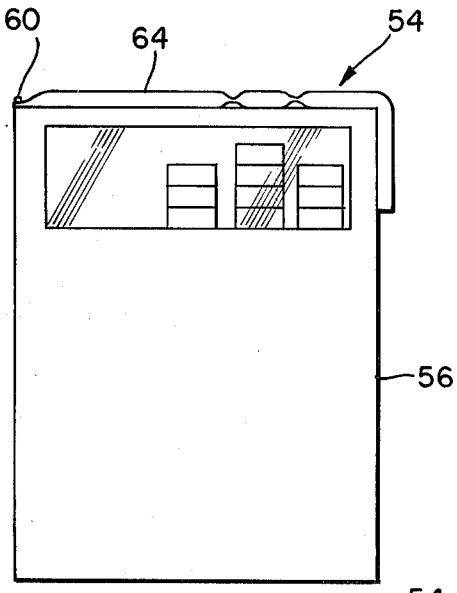
FIG. 9 is a view in end elevation showing the cover installed on an open top type refrigerator, and, FIG. 10 is a top plan thereof.
Figure 10:
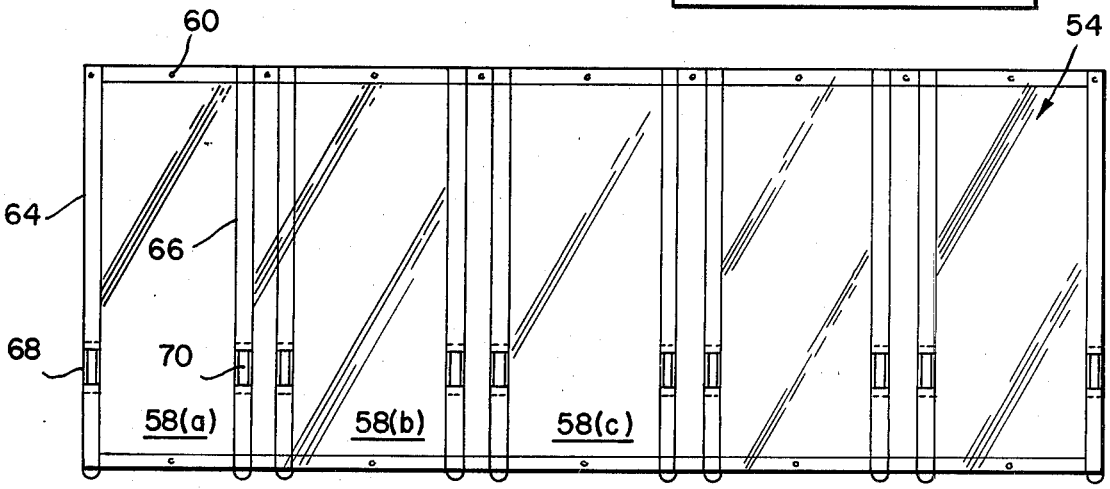

Referring now to FIGS. 9 and 10 of the drawings, there is illustrated another modification of the invention and, in this embodiment, a reach-through curtain 54 is provided for use on a refrigerator unit 56 having a flat open top. In this embodiment, overlapped panels 58(A), 58(B), etc. are provided and are of a construction similar to that of the panels 30 of the principal embodiment. However, in this arrangement, each panel is attached by several fasteners 60 along the rear edge of the freezer unit 56 and a single fastener 62 is provided along the front edge thereof. Again, each panel is provided with longitudinal, tubular margins 64 and 66 including colored tubular inserts 68 and 70. The material is sufficiently flexible that the customer may reach in between the overlapped panel edges and withdraw food produce from the refrigerator. Again, the panels have sufficient length that the forward ends hang over the front edge of the unit, as best shown in FIG. 9.

While the invention has been described with particular reference to the illustrated embodiments, numerous modifications thereto will appear to those skilled in the art.

Having thus described the invention, what we claim and desire to obtain by Letters Patent of the United States is:

1. A reach-through curtain for use over the opening in an open display type refrigerator or the like, comprising (a) a plurality of elongated, flexible, transparent, imperforate panels of generally rectangular outline each connectable at least at one end to said refrigerator proximate to an edge of said opening, (b) said panels extending in parallel, overlapped relation across said opening and defining slit access means between adjacent panels, (c) each of said panels being of a length sufficient to span said opening in one direction, (d) said panels being of a sufficient number and width to span said opening in another direction perpendicular to said one direction, (e) the long edges of each of said panels being tubular, and, (f) a colored, relatively short sleeve mounted in each tubular edge of said panel for visibly enhancing the access joints between adjacent panels and for reinforcing the tubular shape of the long edges.

2. A reach-through curtain according to claim 1 wherein each of said panels is detachably connected to said refrigerator.

3. A reach-through curtain according to claim 1 wherein the long edges of each of said panels is rolled into a tube and fixed at least at the opposite ends thereof.

4. A reach-through curtain according to claim 1 wherein a longitudinally slit flexible tube is mounted along opposite long edges of each panel.

5. A reach-through curtain according to claim 1 including tensioning means connected to the other end of each of said panels for maintaining longitudinal tension on each of said panels.

6. A reach-through curtain according to claim 5 wherein said tensioning means includes weights.

* * * * *